US011571065B2

(12) United States Patent
Hubert

(10) Patent No.: US 11,571,065 B2
(45) Date of Patent: Feb. 7, 2023

(54) MODULAR WORKSTATION ASSEMBLY AND METHOD OF ASSEMBLAGE

(71) Applicant: Garth Hubert, Provo, UT (US)

(72) Inventor: Garth Hubert, Provo, UT (US)

( * ) Notice: Subject to any disclaimer, the term of this patent is extended or adjusted under 35 U.S.C. 154(b) by 0 days.

(21) Appl. No.: 17/187,643

(22) Filed: Feb. 26, 2021

(65) Prior Publication Data

US 2022/0273098 A1 Sep. 1, 2022

(51) Int. Cl.

| | |
|---|---|
| ***A47B 43/00*** | (2006.01) |
| ***A47B 83/00*** | (2006.01) |
| ***A47B 83/04*** | (2006.01) |
| ***A47B 21/00*** | (2006.01) |

(52) U.S. Cl.

CPC ..... *A47B 83/001* (2013.01); *A47B 21/00* (2013.01); *A47B 83/045* (2013.01); *A47B 2200/0066* (2013.01)

(58) Field of Classification Search

CPC . A47B 21/00; A47B 2200/0066; A47B 63/04; A47B 83/045; A47B 87/007; A47B 87/0276; A47B 87/0284; A47B 87/0292

USPC ..... 312/107, 108, 237

See application file for complete search history.

(56) References Cited

U.S. PATENT DOCUMENTS 155,604 A * 10/1874 Wooton ..... A47B 53/02 312/199
2011/0037360 A1* 2/2011 Jakins ..... A47B 63/04 312/237
2016/0166057 A1* 6/2016 Hubert ..... B25H 1/04 312/237

FOREIGN PATENT DOCUMENTS

WO WO-2016164683 A1 * 10/2016 ..... F16B 5/0291

* cited by examiner

*Primary Examiner* — Matthew W Ing
(74) *Attorney, Agent, or Firm* — Steven Rinehart

(57) ABSTRACT

A modular workstation assembly and method of assemblage comprises multiple modules constructed from a relatively small number of components and arranged in several basic geometries. The workstation assembly includes a desk module, an upper cabinet module, a pair of lateral cabinet modules, and a pair of door modules that hingedly join with the other modules. The door modules hingedly join to the lateral cabinet modules to pivotably articulate between an open and closed position. The modules detachably couple in a sequential pattern, forming multiple styles of workstations operable. The different workstations are arranged, so as to enable a user to work from a sitting or standing position, stow items on multiple shelves, and selectively conceal sections of the workstation with hinged articulation by a pair of lateral modules. The modules are further configured for facilitated disassembly and stowage, one-man portability, and minimal tool and skillset requirements for assemblage.

12 Claims, 6 Drawing Sheets

MODULAR WORKSTATION ASSEMBLY AND METHOD OF ASSEMBLAGE

FIELD OF THE INVENTION

This invention relates to a modular workstation assembly and method of assemblage, and more particularly relates to a workstation assembly that comprises multiple modules constructed from a relatively small number of components and arranged in several basic geometries; whereby the modules detachably couple in a sequential pattern to form multiple styles of workstations operable to enable a user to work from a sitting or standing position, stow items on multiple shelves, and selectively conceal sections of the workstation with hinged articulation by a pair of lateral modules; whereby the modules are further configured for facilitated disassembly and stowage, one-man portability, and minimal tool and skillset requirements for assemblage.

BACKGROUND

Description of the Related Art

Often, it is desirable to create a personal workstation in a work area that provides a place to work on office-type, or school-type jobs. It is desirable that such a workstation avoids uniformity and monotony. At the same time, the workstation must be flexible in order to assure maximum freedom in organizing a work area. In short, the workstation must be designed to adapt the workplace to the individual working therein.

Generally, office desks accommodate writing surfaces and allow for the addition of computer equipment. However, computer monitors and keyboards have been placed on traditional desks, where they occupy an inordinate amount of space. It is also desirable to provide a workstation that allows for the efficient organization of devices requiring electrical power within an office, commercial, industrial or residential environment. This has been exacerbated by the proliferation of additional devices for lighting, communications such as complex telephone stations, modems and facsimile machines, computers and computer peripherals such as video displays, printers and the like.

Other proposals have involved office/school furniture systems. The problem with these office furniture systems is that they do not reconfigure to different styles and dimensions. Also, the mobility is limited. Even though the above cited office/school furniture systems meet some of the needs of the market, a workstation assembly that comprises multiple modules constructed from a relatively small number of components and arranged in several basic geometries; whereby the modules detachably couple in a sequential pattern to form multiple styles of workstations operable to enable a user to work from a sitting or standing position, stow items on multiple shelves, and selectively conceal sections of the workstation with hinged articulation by a pair of lateral modules; whereby the modules are further configured for facilitated disassembly and stowage, one-man portability, and minimal tool and skillset requirements for assemblage, is still desired.

SUMMARY

From the foregoing discussion, it should be apparent that a need exists for a modular workstation assembly and method of assemblage that comprises multiple modules constructed from a relatively small number of components and arranged in several basic geometries. Beneficially, such a workstation assembly would include multiple modules that are configured to detachably couple in a sequential pattern, forming multiple styles of workstations operable. The different workstations are arranged, so as to enable a user to work from a sitting or standing position, stow items on multiple shelves, and selectively conceal sections of the workstation with hinged articulation by a pair of lateral modules. The modules are further configured for facilitated disassembly and stowage, one-man portability, and minimal tool and skillset requirements for assemblage.

The present invention has been developed in response to the present state of the art, and in particular, in response to the problems and needs in the art that have not yet been fully solved by currently available workstations Accordingly, the present invention has been developed to provide a modular workstation assembly that overcome many or all of the above-discussed shortcomings in the art.

The workstation assembly is provided with a plurality of modules configured to functionally execute the necessary steps of assemblage with minimal tools and skill set. These modules in the described embodiments include a desk module modular workstation assembly.

In some embodiments, the assembly includes a desk module. The desk module comprises a top panel, a bottom panel, and a pair of side panels. The panels of the desk module have a front edge and a rear edge. The panels form a substantially rectangular shape. The desk module further has a work surface spanning the side panels and extending past the front edge of the panels. The desk module also has multiple desk dividers that span the work surface and the bottom panel.

In some embodiments, the assembly includes an upper cabinet module. The upper cabinet module comprises a top panel, a bottom panel, and a pair of side panels. The panels of the upper cabinet module having a front edge and a rear edge. The panels form a substantially cubical shape. The upper cabinet module may also comprise multiple upper cabinet shelves that span the top panel and the bottom panel of the upper cabinet module. The bottom panel of the upper cabinet module detachably joins with the top panel of the desk module. This detachably attachment enables the upper cabinet module to be easily stacked, removed, and realigned with the desk module.

In some embodiments, the assembly includes a pair of door modules that comprise a top panel, a bottom panel, and a pair of side panels. The panels of the door modules have a front edge and a rear edge. The panels join at their ends to form a substantially rectangular shape. The door modules also comprise a door panel that joins with the rear edge of the panels for the door modules. The door modules also comprise multiple door shelves that span the side panels of the door modules.

Furthermore, the side panels of the door modules hingedly join with the side panels of the desk module and the upper cabinet module. In this manner, the door modules pivotably articulate between an open position and a closed position. In the open position the door modules extend linearly from the sides of the desk module and upper cabinet module. And in the closed position, the front edges of the panels for the door modules engage the front edges of the panels for the desk module and the upper cabinet module.

The assembly, in one embodiment, further comprises a pair of lateral cabinet modules comprising a top panel, a bottom panel, and a pair of side panels, the panels of the lateral cabinet modules having a front edge and a rear edge.

The assembly is further configured, in one embodiment, such that the lateral cabinet modules further comprise at least one lateral cabinet shelf spanning the side panels of the lateral cabinet modules.

In a further embodiment, the assembly may be configured wherein the lateral cabinet modules further comprise at least one vertical divider disposed perpendicular with the top and bottom panels of the lateral cabinet modules.

In a further embodiment, the lateral cabinet modules further comprise at least one horizontal divider disposed perpendicular with the side panels of the lateral cabinet modules.

In a further embodiment, the side panels of the door modules are hingedly joined with the side panels of the lateral cabinet modules.

In a further embodiment, the assembly further comprises multiple wheels or rollers operatively joined with the bottom panels of the lateral cabinet modules.

In a further embodiment, the assembly further comprises a hinge operatively joined with the side panels of the door modules and the side panels of the desk module and the upper cabinet module. The hinge enables pivotable articulation of the door modules between the open and closed positions.

In a further embodiment, the desk module further comprises a rear panel joined with the rear edge of the panels for the desk module.

In a further embodiment, the upper cabinet module further comprises a rear panel joined with the rear edge of the panels for the upper cabinet module.

In a further embodiment, the door panel of the door modules are disposed parallel with the rear panels of the desk module and the upper cabinet module.

In a further embodiment, the front edge of the side panels for the door modules are hingedly joined with the front edge of the side panels for the desk module and the upper cabinet module.

In a further embodiment, the side panels of the door modules are detachable) from the side panels of the desk module and the upper cabinet module.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
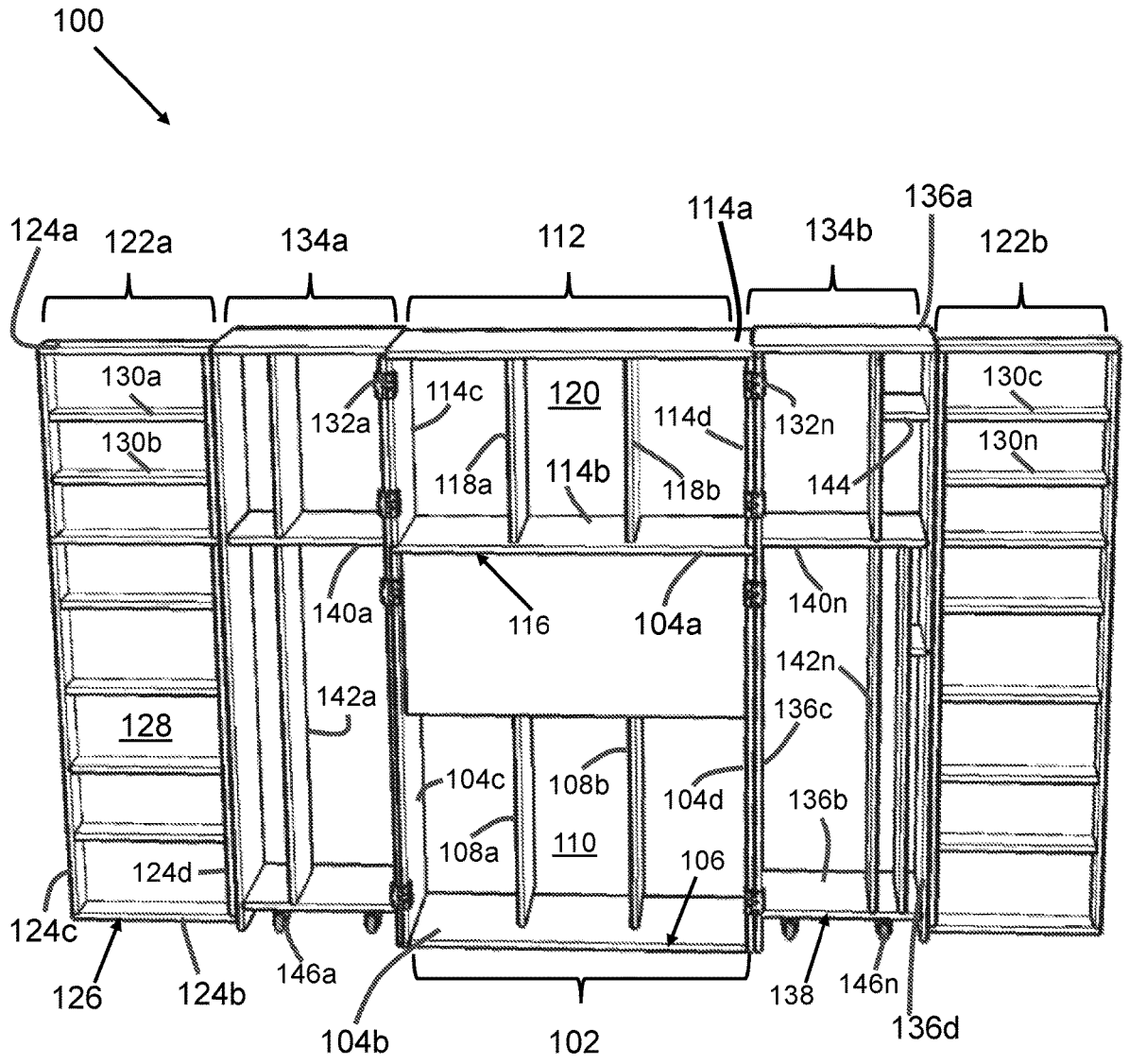
FIG. 1 is a perspective view illustrating one embodiment of a modular workstation assembly, in accordance with the present invention.

FIG. 1 depicts a modular workstation assembly 100, hereafter "assembly 100". The assembly 100 utilizes multiple, unique modules that are easily arranged in different combinations, positions, and pivotable articulations. The modules may include, without limitation, a desktop module, an upper cabinet module, a pair of lateral cabinet modules, and a pair of door modules. The modules are constructed from a relatively small number of components and arranged in several basic geometries.

In one possible embodiment, the upper cabinet module stacks atop the desktop module. This allows a user to work in a sitting position at the desktop module, or a standing position at the upper cabinet module. The lateral cabinet modules provide out-of-the-way stowage options to the user. The door modules hingedly join to the lateral cabinet modules, so as to pivotably articulate between an open and closed position. The closed position allows the user to conceal the contents of the lateral cabinet modules, and in some cases, the upper cabinet module.

Figure 2A:
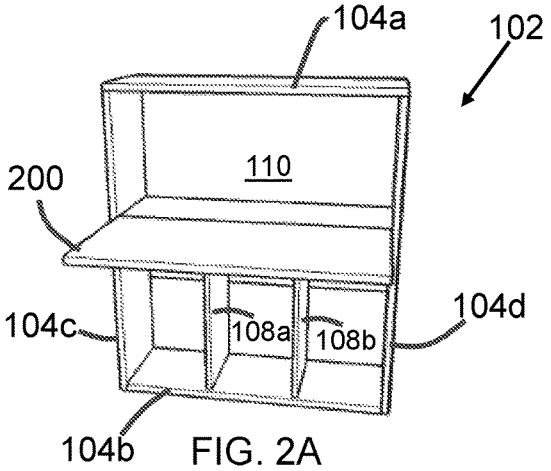
FIG. 2A is a perspective view illustrating one embodiment of a desk module for the modular workstation assembly, in accordance with the present invention.

The modules are uniquely configured to detachably couple from each other in a sequential pattern, so as to allow a user to easily create multiple styles and dimensions of workstations. This reconfigurable modular design allows flexibility for different working functions and different rooms. The modules are further configured for facilitated disassembly 100 and stowage, one-man portability, and minimal tool and skillset requirements for assemblage Looking now at FIG. 2A, the assembly 100 includes a desk module 102. The desk module 102 comprises a top panel 104*a*, a bottom panel 104*b*, and a pair of side panels 104*c*, 104*d*. The panels 104*a-d* of the desk module 102 have a front edge 106 and a rear edge 500. The panels 104*a-d* form a substantially rectangular shape. However, in alternative embodiments, a more cubicle, circular, pyramidical, or irregular shape may also be formed. Suitable materials for the panels 104*a-d* may include, without limitation, wood, wood pulp, polymers, polyurethane, polyvinyl chloride, polyethylene, aluminum, and metal alloys.

The desk module 102 further has a work surface 200 spanning the side panels 104*c*, 104*d*, and extending past the front edge 106 of the panels 104*a-d*. In some embodiments, the work surface 200 may be a simple rectangular or square-shaped panel, i.e., table, adapted to enable a user to write, type, or drawn upon. The work surface 200 may also support a keyboard or a computer.

Figure 6:
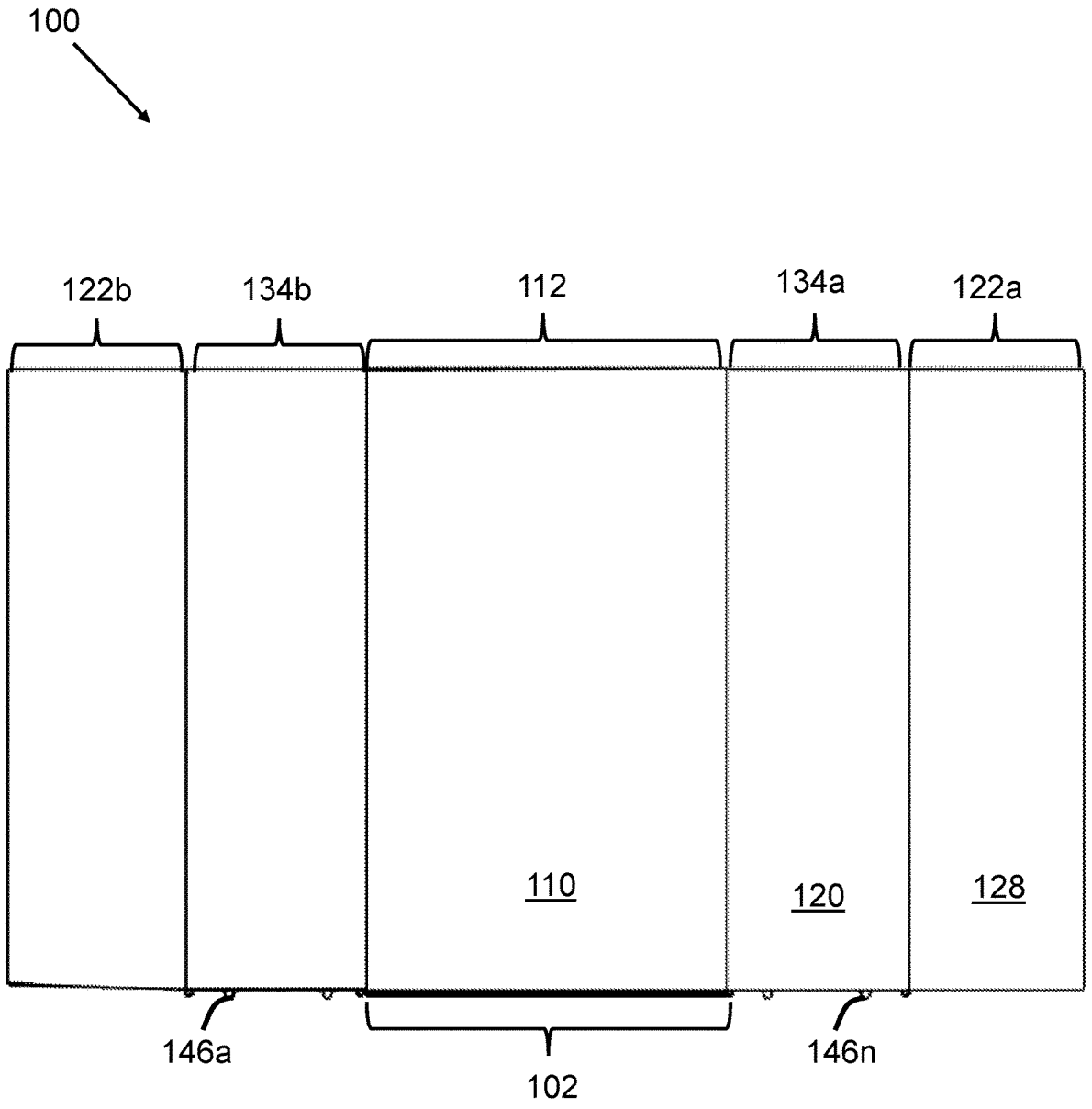
FIG. 6 is a rear view illustrating the modular workstation assembly, in accordance with the present invention.

The desk module 102 also has multiple desk dividers 108*a*, 108*b* that span the work surface 200 and the bottom panel 104*b*. Looking ahead to FIG. 6, the desk module 102 may also include a rear panel 110 that joins with the rear edge 500 of the panels 104*a-d* for the desk module 102. The rear panel 110 provides a protective wall that creates greater privacy for a workstation at which a user sits.

Figure 2B:
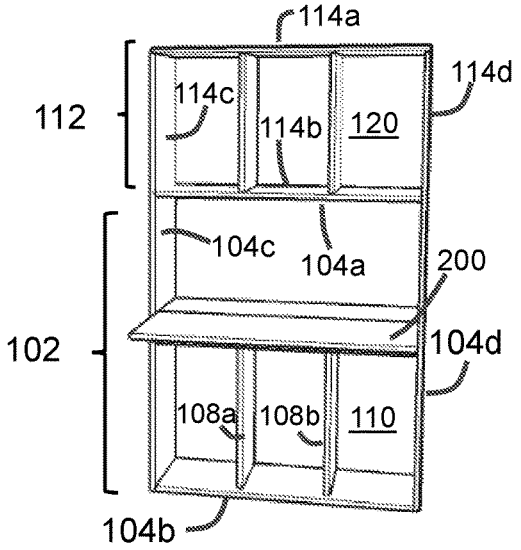
FIG. 2B is a perspective view illustrating one embodiment of an upper cabinet module stacked atop the desk module, in accordance with the present invention.

As referenced in FIG. 2B, the assembly 100 includes an upper cabinet module 112. The upper cabinet module comprises a top panel 114*a*, a bottom panel 114*b*, and a pair of side panels 114*c*, 114*d*. The panels 114*a-d* of the upper cabinet module are defined by a front edge 116 and a rear edge 400. In one embodiment, the front edge 116 of the panels 114*a-d* are oriented towards where the user will be positioned for working thereon. The panels 114*a-d* form a substantially cubical shape. However, in alternative embodiments, a more cubicle, circular, pyramidical, or irregular shape may also be formed. Suitable materials for the panels 114*a-d* may include, without limitation, wood, wood pulp, polymers, polyurethane, polyvinyl chloride, polyethylene, aluminum, and metal alloys.

The upper cabinet module 112 may also comprise multiple upper cabinet dividers 118*a*, 118*b* that span the top panel 114*a* and the bottom panel 114*b* of the upper cabinet module 112. The upper cabinet dividers 118*a*, 118*b* are arranged in a parallel, spaced-apart relationship that enables items to be organized in the upper cabinet module 112. The upper cabinet dividers 118*a*, 118*b* may include a simple flat panel that slidably engages rails, or snugly fits into the top and bottom panels 114*a-b*.

The upper cabinet module 112 is easily detachable from the desk module 102. In some embodiments, the bottom panel 114*b* of the upper cabinet module 112 is configured to detachably attach to the top panel of the desk module 102. For example, the upper cabinet module can be screwed, glued, magnetized, or friction-fit attached to the desk module. However, in other embodiments, weight and gravity work to retain the upper cabinet module on the desk module 102. This detachably attachment enables the upper cabinet module 112 to be easily stacked, removed, and realigned with the desk module 102. Looking again at FIG. 6, the upper cabinet module 112 comprises a rear panel 120 that joins with the rear edge of the panels 114*a-d*. The rear panel 120 provides a protective wall that creates greater privacy for the workstation.

Figure 2C:
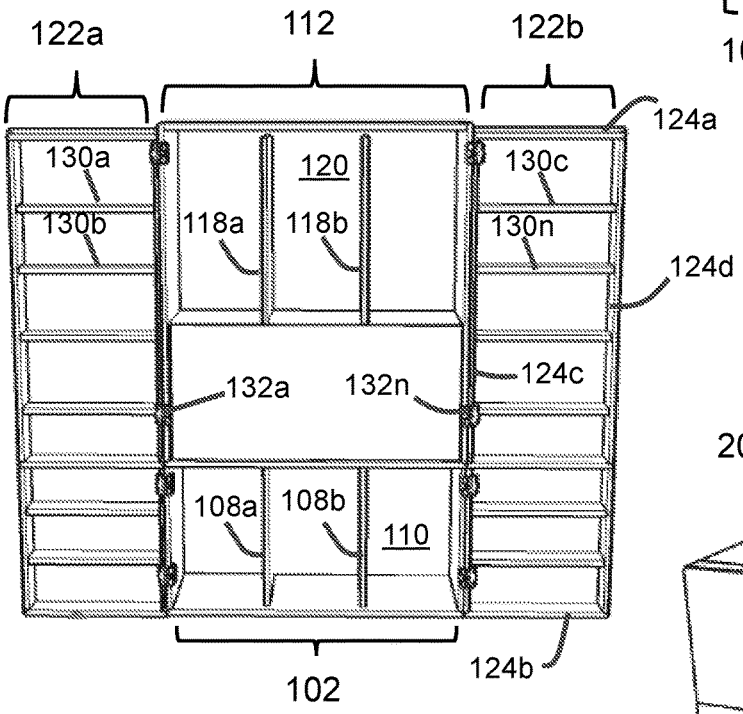
FIG. 2C is a perspective view illustrating one embodiment of a pair of door modules hingedly joined to the sides of the desk module and upper cabinet module, in accordance with the present invention.

As FIG. 2C shows, the assembly 100 includes a pair of door modules 122*a*, 122*b* that comprise a top panel 124*a*, a bottom panel 124*b*, and a pair of side panels 124*c*, 124*d*. The panels 124*a-d* of the door modules 122*a-b* have a front edge 126 and a rear edge 402. In one embodiment, the front edge 126 of the panels 124*a-d* are oriented towards where the user will be positioned for working thereon. The panels 124*a-d* join at their ends to form a substantially rectangular shape. The door modules 122*a-b* also comprise a door panel 128 that joins with the rear edge 402 of the panels 124*a-d* for the door modules 122*a-b*. In some embodiments, the door panel 128 is parallel with the rear panels 110, 120 of the desk module 102 and the upper cabinet module 112. The door panel 128 provides a solid wall to the door panel 128.

The door modules 122*a-b* also comprise multiple door shelves 130*a*, 130*b*, 130*c*, 130*n* that span the side panels 124*c-d* of the door modules 122*a-b*. The door shelves 130*a*, 130*b*, 130*c*, 130*n* are disposed horizontally, and sized to support items, such as papers, files, books, ornamentals, and computing devices. Suitable materials for the panels 124*a-d* and the door shelves 130*a*, 130*b*, 130*c*, 130*n* may include, without limitation, wood, wood pulp, polymers, polyurethane, polyvinyl chloride, polyethylene, aluminum, and metal alloys.

Figure 2D:
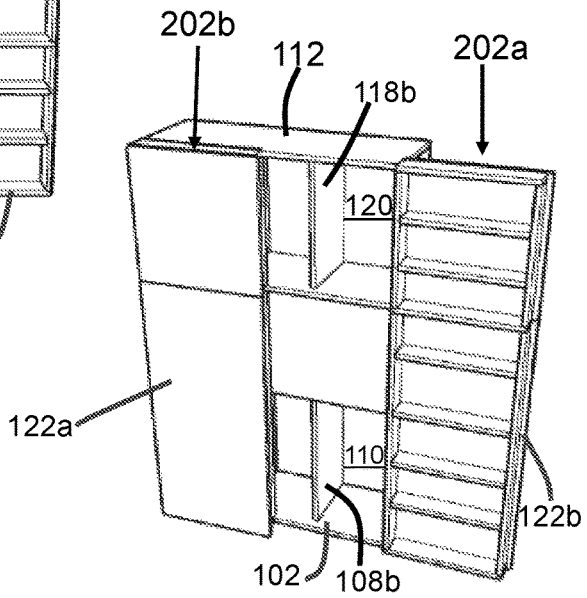
FIG. 2D is a perspective view illustrating the right-side door module in the closed position, and the left-side door module in the open position, in accordance with the present invention.

Furthermore, the side panels 124*c*, 124*d* of the door modules 122*a-b* hingedly join with the side panels 104*c-d*, 114*c-d* of the desk module 102 and the upper cabinet module 112. More specifically, the front edge 126 of the side panels 124*c-d* for the door modules 122*a-b* hingedly join with the front edges 106, 116 of the side panels 104*c-d*, 114*c-d* for both the desk module 102 and upper cabinet module 112. In this manner, the door modules 122*a-b* pivotably articulate between an open position 202*a* and a closed position 202*b*. For example, FIG. 2D is a perspective view illustrating the right-side door module 122*a* in the closed position 202*b*, and the left-side door module 122*b* in the open position 202*a*.

Figure 4:
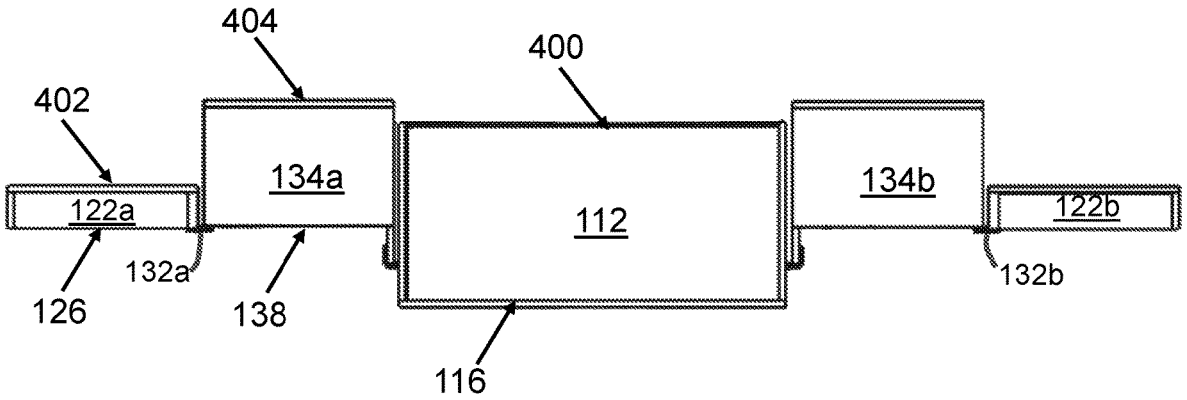
FIG. 4 is a top view illustrating the modular workstation assembly, in accordance with the present invention.
Figure 5:
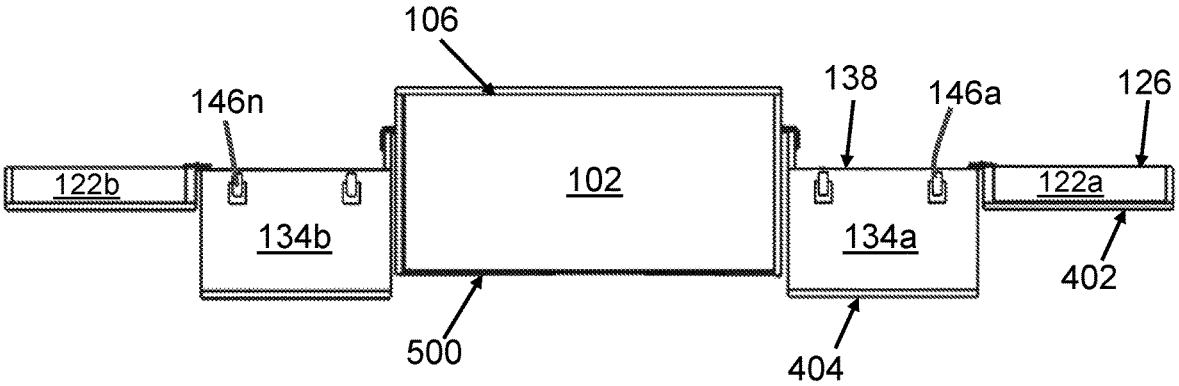
FIG. 5 is a bottom view illustrating the modular workstation assembly, in accordance with the present invention.

In the open position 202*a* the door modules 122*a-b* extend linearly from the sides of the desk module 102 and upper cabinet module 112 (See FIG. 4). And in the closed position 202*b*, the front edge 126 of the panels 124*a-d* for the door modules 122*a-b* engage the front edges 106, 116 of the side panels 104*c-d*, 114*c-d*, for both the desk module 102 and upper cabinet module 112. Also, in the closed position 202*b*, the upper cabinet dividers 118*a-b* and bottom panel 114*b* are concealed.

In another embodiment, at least one hinge 132*a*, 132*n* is utilized to create a hinged relationship between the side panels 124*c-d* of the door modules 122*a-b*, and the side panels 104*c-d*, 114*c-d* of the desk module 102 and the upper cabinet module. The hinge 132*a*, 132*n* may attach to the front edges of the respective panels, so as to enable pivotable articulation in a forward direction. The hinge 132*a*, 132*n* enables pivotable articulation of the door modules 122*a-b* between the open and closed positions 202*a*, 202*b*. The at least one hinge 132*a*, 132*n* may include, without limitation, a door hinge, a barrel hinge, or any mechanical bearing that connects panels to enable pivotable articulation thereof.

Consistent with the modular configuration of the assembly 100, the side panels of the door modules 122*a-b* are detachable from the side panels 104*c-d*, 114*c-d* of the desk module 102 and the upper cabinet module 112. This detachment may be performed by removing the hinge 132*a*, 132*n*, if a hinge 132*a*, 132*n* is used.

Figure 3A:
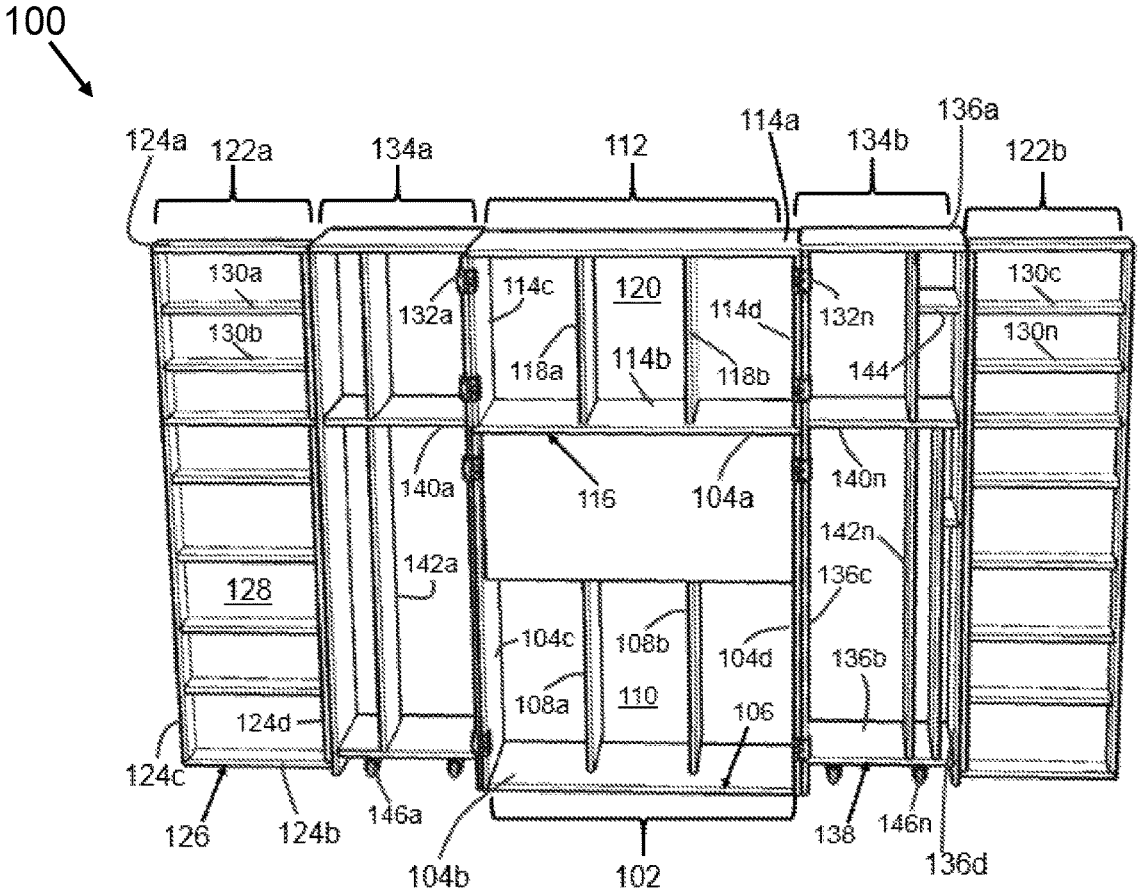
FIG. 3A is a perspective view illustrating one embodiment of a pair of lateral cabinet modules joined with the desk module for the modular workstation assembly, in accordance with the present invention.
Figure 7:
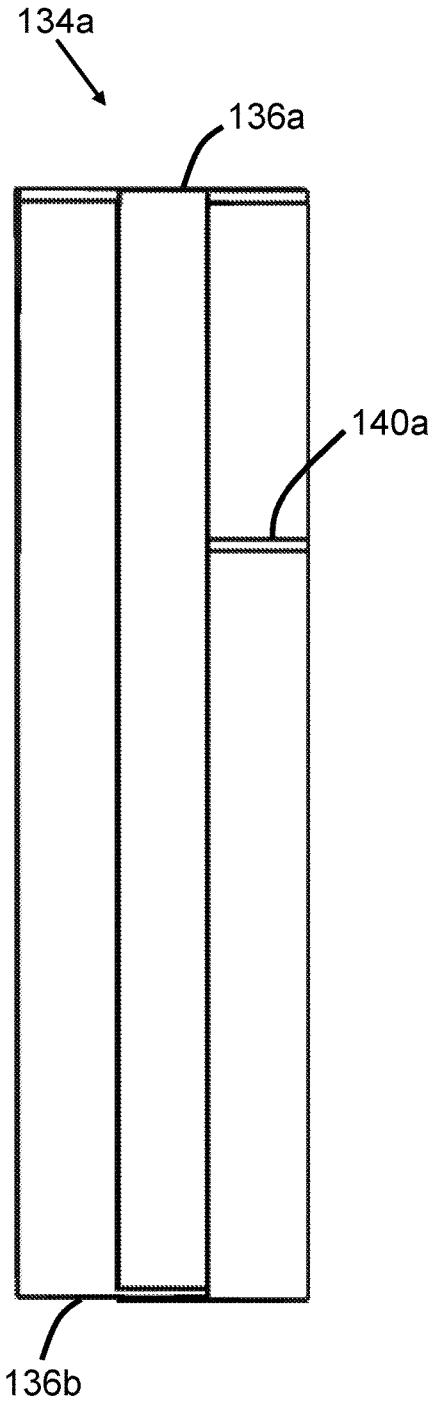
FIG. 7 is a left-side view illustrating the modular workstation assembly, in accordance with the present invention.
Figure 8:
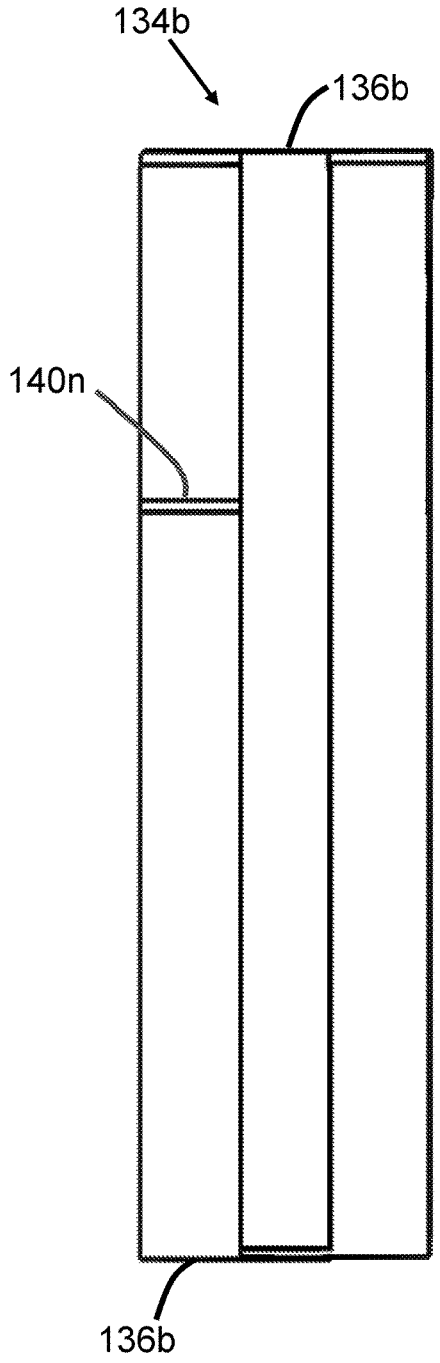
FIG. 8 is a right-side view illustrating the modular workstation assembly, in accordance with the present invention.

Turning now to FIG. 3A, the assembly 100, also includes a pair of lateral cabinet modules 134*a-b*, useful for stowing items and providing structural integrity to the assembly 100. FIG. 7 is a left-side view illustrating a left lateral cabinet module 134*a*, modular workstation assembly 100; and FIG. 8 is a right-side view illustrating a right lateral cabinet module 134*b*. The lateral cabinet modules 134*a-b* are made up of a top panel 136*a*, a bottom panel 136*b*, and a pair of side panels 136*c*, 136*d*, with the panels 136*a-d* having a front edge 138 and a rear edge 404. In one embodiment, the front edge 138 of the panels 136*a-d* are oriented towards where the user will be positioned for working thereon. The panels 136*a-d* form a substantially rectangular shape. However, in alternative embodiments, a more cubicle, circular, pyramidical, or irregular shape may also be formed. Suitable materials for the panels 136*a-d* may include, without limitation, wood, wood pulp, polymers, polyurethane, polyvinyl chloride, polyethylene, aluminum, and metal alloys.

The lateral cabinet modules 134*a-b* allow unique compartmentalization and organization of items through segregated sections of shelves. Like the other modules, the lateral cabinet modules 134*a-b* are detachable and easy to reposition, which allows the user to create different styles of workstations. However, due to the modular configuration of the assembly 100, the workstation configurations may be possible with or without the lateral cabinet modules 134*a-b*.

In one embodiment, the lateral cabinet modules 134*a-b* provide at least one lateral cabinet shelf 140*a*, 140*n* that spans the side panels 136*c-d* of the lateral cabinet modules 134*a-b*. The lateral cabinet shelf 140*a-n* is configured to support items, including books, paperwork, files, display screens, and computing devices.

To further compartmentalize the lateral cabinet modules 134*a-b*, the assembly 1100 also provides at least one vertical divider 142*a*, 142*n*. The vertical divider 142*a-n* is disposed perpendicular with the top and bottom panels 136*a-b* of the lateral cabinet modules 134*a-b*. In yet another embodiment, the lateral cabinet modules 134*a-b* comprise at least one horizontal divider 144 that is disposed perpendicular with the side panels 136*c-d* of the lateral cabinet modules 134*a-b*. The vertical and horizontal dividers 142*a-n*, 144 can be manipulated to create differently sized storage compartments for the lateral cabinet modules 134*a-b*.

Figure 3B:
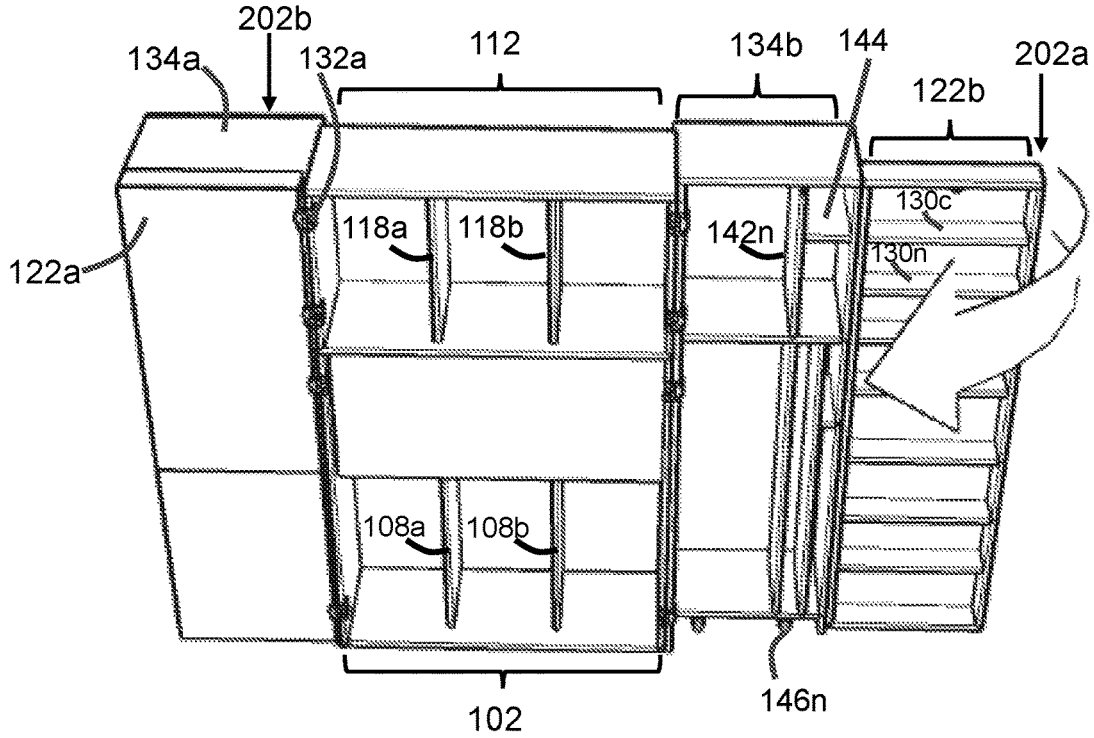
FIG. 3B is a perspective view illustrating one embodiment of a pair of lateral cabinet modules, with the right-side door module in the closed position, and the left-side door module in the open position, in accordance with the present invention.

Also, each lateral cabinet module 134*a*, 134*b* can have different numbers and lengths of vertical and horizontal dividers 142*a-n*, 144. For example, FIG. 3A shows a right-side lateral cabinet module 134*a* with a long horizontal divider, a short horizontal divider, and one long vertical divider. A left-side lateral cabinet module 134*b* has a long horizontal divider and one long vertical divider In some embodiment, the side panels 124*c-d* of the door modules 122*a-b* are hingedly joined with the side panels 136*c-d* of the lateral cabinet modules 134*a-b*. In this unique arrangement, the lateral cabinet modules 134*a-b* position between the desk module 102 and the door modules 122*a-b*. When the door modules 122*a-b* hingedly join in this manner, the door modules 122*a-b* pivotably articulate between an open position 202*a* and a closed position 202*b* (See FIG. 3B).

In the open position 202*a* the door modules 122*a-b* extend linearly from the sides of the lateral cabinet modules 134*a-b*. And in the closed position 202*b*, the front edges 126 of the panels for the door modules 122*a-b* engage the front edges 138 of the panels for the lateral cabinet modules 134*a-b*. Also, in the closed position 202*b*, the items on the lateral cabinet shelf 140*a-n* are concealed.

However, as discussed above, the lateral cabinet modules 134*a-b* may be removed from the workstation arrangement. When removed, the door modules 122*a-b* pivotably articulate about the desk module 102 and the upper cabinet module 112. For example, FIG. 2C illustrates the lateral cabinet modules 134*a-b* removed from the assembly 100; and FIG. 3A illustrates the lateral cabinet modules 134*a-b* attached between the door modules 122*a-b* and the desk module 102.

The at least one hinge 132*a*, 132*n* is utilized to create a hinged relationship between the side panels 124*c-d* of the door modules 122*a-b*, and the side panels 136*c-d* of the lateral cabinet modules 134*a-b*. The hinge 132*a*, 132*n* may attach to the front edges of the respective panels, so as to enable pivotable articulation in a forward direction. The hinge 132*a*, 132*n* enables pivotable articulation of the door modules 122*a-b* between the open and closed positions 202*a*, 202*b*.

And since the assembly 100 is modular and configured to be arranged into multiple types of workstations, the inner side panels of the door modules are detachable from the outer side panels of the desk module 102 and the upper cabinet module 112. This may be performed by removing the hinge 132*a*, 132*n*, if a hinge is used.

As discussed above, the assembly 100 is mobile. This mobility allows the workstation to be moved from room-to-room, and arranged in a desired workstation configuration. Thus, in one possible embodiment, the assembly 100 further comprises multiple wheels or rollers 146*a*, 146*n* operatively joined with the bottom panels 136*b* of the lateral cabinet modules 134*a-b*. And in other embodiments, the desk module 102 and the door modules 122*a-b* may also have wheels or rollers. In alternative embodiments, other types of mobility components, beyond wheels or rollers, may be used, including rails, slides, and a slick surface.

The assemblage of the workstation assembly 100 is relatively easy, requiring minimal skill sets and tools. In operation, a desk module 102 is placed in a desired location. This positioning may set the rear edge of the panels against a wall, or the desk module may be arranged within a series of workstation assemblies, such as a cubicle arrangement in an office. The front edges of the panels are oriented towards the user, where working thereon. Next, the upper cabinet module 112 is stacked atop the desk module 102, with the bottom panel 114*b* of the upper cabinet module 112 engaging the top panel 104*a* of the desk module 102. The upper cabinet module 112 may rest on the desk module 102 with only weight and gravity holding the upper cabinet module in place. However, fasteners may also be used.

A pair of lateral cabinet modules are joined with the side panels of the desk module and the upper cabinet modules. The lateral cabinet modules can be useful for placing items, such as paperwork, files, computers, ornaments, and the like. A pair of door modules are then hingedly joined with the side panels of the lateral cabinet modules. When the door modules 122*a-b* hingedly join in this manner, the door modules 122*a-b* pivotably articulate between an open position 202*a* and a closed position 202*b* (See FIG. 3B). In the open position 202*a* the door modules 122*a-b* extend linearly from the sides of the lateral cabinet modules 134*a-b*. And in the closed position 202*b*, the front edges 126 of the panels for the door modules 122*a-b* engage the front edges 138 of the panels for the lateral cabinet modules 134*a-b*. Items placed on shelves in the door modules may also be concealed from the closed position. After full assemblage, the workstation can be rolled to a new position with minimal effort due to the wheels or rollers.

In conclusion, a modular workstation assembly 100 comprises multiple modules constructed from a relatively small number of components and arranged in several basic geometries. The workstation assembly includes a desk module, an upper cabinet module, a pair of lateral cabinet modules, and a pair of door modules that hingedly join with the other modules. The door modules hingedly join to the lateral cabinet modules to pivotably articulate between an open and closed position. The modules detachably couple in a sequential pattern, forming multiple styles of workstations operable. The different workstations are arranged, so as to enable a user to work from a sitting or standing position, stow items on multiple shelves, and selectively conceal sections of the workstation with hinged articulation by a pair of lateral modules. The modules are further configured for facilitated disassembly and stowage, one-man portability, and minimal tool and skillset requirements for assemblage.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A modular workstation assembly, the assembly comprising:

a desk module comprising:

a top panel, a bottom panel, two or more rollers, and a pair of side panels, the panels of the desk module having a front edge and a rear edge, a work surface spanning the side panels and extending past the front edge of the panels, the desk module further having multiple desk dividers spanning the work surface and the bottom panel;

an upper cabinet module stacked above the desk module and detachably affixed to the desk module using screws, the upper cabinet module comprising:

a top panel, a bottom panel, and a pair of side panels, the panels of the upper cabinet module having a front edge and a rear edge, multiple upper cabinet dividers spanning the top panel and the bottom panel of the upper cabinet module, wherein the bottom panel of the upper cabinet module is detachably joined with the top panel of the desk module;

two or more lateral cabinet modules comprising a top panel, a bottom panel, two or more rollers, and a pair of side panels, the panels of the lateral cabinet modules having a front edge and a rear edge;

wherein a side panel of each lateral cabinet module is hingedly joined with a side panel of the desk module using two or more hinges, whereby, in the open position, the lateral cabinet modules sits adjacent to the desk module and a side panel of the lateral cabinet module abuts a side panel of the desk module, wherein a side panel of each lateral cabinet module is hingedly joined with a side panel of a door module, a pair of door modules comprising:

a top panel, a bottom panel, and a pair of side panels, the panels of the door modules having a front edge and a rear edge, the door modules further comprising a door panel joined with the rear edge of the panels for the door modules, the door modules further comprising multiple door shelves spanning the side panels of the door modules, wherein a side panel of each door module is hingedly joined with a side panel of a lateral cabinet module using two or more hinges, wherein the door modules are operable to pivotably articulate between an open position and a closed position, whereby, in the closed position, the front edges of the panels for the door modules engage the front edges of the panels for the desk module and the upper cabinet module;

whereby, in the open position, the door modules sits adjacent to a lateral cabinet module and a side panel of the door module abuts a side panel of the lateral cabinet module.

2. The assembly of claim 1, wherein the lateral cabinet modules further comprise at least one lateral cabinet shelf spanning the side panels of the lateral cabinet modules.

3. The assembly of claim 1, wherein the lateral cabinet modules further comprise at least one vertical divider disposed perpendicular with the top and bottom panels of the lateral cabinet modules.

4. The assembly of claim 1, wherein the lateral cabinet modules further comprise at least one horizontal divider disposed perpendicular with the side panels of the lateral cabinet modules.

5. The assembly of claim 1, wherein the side panels of the door modules are hingedly joined with the side panels of the lateral cabinet modules.

6. The assembly of claim 1, further comprising multiple wheels or rollers operatively joined with the bottom panels of the lateral cabinet modules.

7. The assembly of claim 1, further comprising a hinge operatively joined with the side panels of the door modules and the side panels of the desk module and the upper cabinet module, the hinge enabling pivotable articulation of the door modules.

8. The assembly of claim 1, wherein the desk module further comprises a rear panel joined with the rear edge of the panels for the desk module.

9. The assembly of claim 8, wherein the upper cabinet module further comprises a rear panel joined with the rear edge of the panels for the upper cabinet module.

10. The assembly of claim 9, wherein the door panel of the door modules are disposed parallel with the rear panels of the desk module and the upper cabinet module.

11. The assembly of claim 1, wherein the front edge of the side panels for the door modules are hingedly joined with the front edge of the side panels for the desk module and the upper cabinet module.

12. The assembly of claim 1, wherein the side panels of the door modules are detachable from the side panels of the desk module and the upper cabinet module.

* * * * *